US010056698B2

(12) United States Patent
Montgomery et al.

(10) Patent No.: US 10,056,698 B2
(45) Date of Patent: Aug. 21, 2018

(54) MULTIPLE BEAM ANTENNA SYSTEMS WITH EMBEDDED ACTIVE TRANSMIT AND RECEIVE RF MODULES

(71) Applicant: Honeywell International Inc., Morristown, NJ (US)

(72) Inventors: James Patrick Montgomery, Marietta, GA (US); Yaozhong Liu, Torrance, CA (US)

(73) Assignee: Honeywell International Inc., Morris Plains, NJ (US)

( * ) Notice: Subject to any disclaimer, the term of this patent is extended or adjusted under 35 U.S.C. 154(b) by 400 days.

(21) Appl. No.: 14/621,997

(22) Filed: Feb. 13, 2015

(65) Prior Publication Data

US 2016/0111793 A1 Apr. 21, 2016

Related U.S. Application Data

(60) Provisional application No. 62/066,149, filed on Oct. 20, 2014.

(51) Int. Cl.
*H01Q 3/26* (2006.01)
*H01Q 3/00* (2006.01)
(Continued)

(52) U.S. Cl.
CPC ..... *H01Q 21/0006* (2013.01); *H01P 3/127* (2013.01); *H01Q 3/24* (2013.01);
(Continued)

(58) Field of Classification Search
CPC ..... H01Q 21/0006; H01Q 21/20; H01Q 21/0031; H01Q 3/24; H01Q 3/245;
(Continued)

(56) References Cited

U.S. PATENT DOCUMENTS 3,618,090 A * 11/1971 Garrison ..... G01S 1/02 342/147
5,034,752 A 7/1991 Pourailly et al.
(Continued)

FOREIGN PATENT DOCUMENTS

EP 1041673 10/2000

OTHER PUBLICATIONS

Euopean Patent Office, "Extended European Search Report from EP Application No. 15189447.4", "from Foreign Counterpart of U.S. Appl. No. 14/621,997", dated Mar. 31, 2016, pp. 1-7.
(Continued)

*Primary Examiner* — Harry K Liu
(74) *Attorney, Agent, or Firm* — Fogg & Powers LLC

(57) ABSTRACT

Multiple beam antenna systems with embedded active transmit and receive RF modules are provided. In one embodiment, an active multiple beam antenna system includes: a spherical lens; a plurality of planar multi-feed assemblies spaced around a region of the spherical lens, wherein each of the planar multi-feed assemblies comprises: a plurality of feeds spaced around and directed into the spherical lens; a plurality of transmit/receive active modules, wherein one respective transmit/receive active module of the plurality of transmit/receive active modules is coupled to each of the plurality of feeds; a first power divider coupled to each of the plurality of transmit/receive active modules; and a second power divider coupled to the first power divider of each of the plurality of planar multi-feed assemblies, the first power divider further configured to couple with a datalink radio.

17 Claims, 7 Drawing Sheets

(51) Int. Cl.

| | |
|---|---|
| ***H01Q 21/00*** | (2006.01) |
| ***H01P 3/127*** | (2006.01) |
| ***H01Q 15/08*** | (2006.01) |
| ***H01Q 25/00*** | (2006.01) |
| ***H01Q 3/24*** | (2006.01) |
| ***H01Q 19/06*** | (2006.01) |
| ***H01Q 21/20*** | (2006.01) |

(52) U.S. Cl.
CPC ..... *H01Q 3/245* (2013.01); *H01Q 15/08* (2013.01); *H01Q 19/062* (2013.01); *H01Q 21/0031* (2013.01); *H01Q 21/20* (2013.01); *H01Q 25/008* (2013.01)

(58) Field of Classification Search
CPC .... H01Q 19/062; H01Q 25/008; H01Q 15/08; H01Q 21/0018; H01Q 21/06; H01Q 15/04; H01P 3/127
USPC ..... 342/368
See application file for complete search history.

(56) References Cited

U.S. PATENT DOCUMENTS

| | | | | |
|---|---|---|---|---|
| 5,495,258 | A | 2/1996 | Muhlhauser et al. | |
| 5,539,415 | A * | 7/1996 | Metzen | H01Q 25/00 343/700 MS |
| 5,548,294 | A | 8/1996 | Sturza | |
| 5,677,796 | A | 10/1997 | Zimmerman et al. | |
| 5,736,959 | A | 4/1998 | Patterson et al. | |
| 5,821,908 | A * | 10/1998 | Sreenivas | H01Q 15/06 343/753 |
| 5,831,582 | A | 11/1998 | Muhlhauser et al. | |
| 6,292,134 | B1 | 9/2001 | Bondyopadhyay | |
| 6,396,448 | B1 | 5/2002 | Zimmerman et al. | |
| 6,987,489 | B2 | 1/2006 | Melconian et al. | |
| 8,648,768 | B2 | 2/2014 | Mussler | |
| 2004/0027279 | A1 | 2/2004 | Jacomb-Hood | |
| 2014/0104014 | A1 | 4/2014 | Hoover et al. | |
| 2014/0104017 | A1 | 4/2014 | Hoover et al. | |
| 2014/0203967 | A1* | 7/2014 | Aydin | H01Q 3/26 342/372 |
| 2014/0285278 | A1 | 9/2014 | Kroening et al. | |
| 2015/0042411 | A1 | 2/2015 | Covert et al. | |
| 2015/0054596 | A1 | 2/2015 | Rogers et al. | |
| 2015/0054702 | A1 | 2/2015 | Rogers | |
| 2015/0091671 | A1 | 4/2015 | Rogers et al. | |
| 2015/0207196 | A1 | 7/2015 | Kroening | |
| 2015/0214616 | A1 | 7/2015 | Rogers et al. | |
| 2017/0324171 | A1 | 11/2017 | Shehan | |

OTHER PUBLICATIONS

Kroening, "Waveguide Circulator Having Stepped Floor/Ceiling and Quarter-Wave Dielectric Transformer", "U.S. Appl. No. 14/159,824, filed Jan. 21, 2014", Jan. 21, 2014, pp. 1-43, Published in: US.

Rogers et al., "Matching and Pattern Control for Dual Band Concentric Antenna Feed", "U.S. Appl. No. 14/163,351, filed Jan. 24, 2014", Jan. 24, 2014, pp. 1-46, Published in: US.

Himdi et al., "An Active Transmitter Antenna with Beam Scanning and Beam Shaping Capability for 60GHz Application", "Proceedings of ISAP2012", 2012, pp. 263-266, Published in: Nagoya, Japan.

"Low Noise Active Receiver Feeds for Multibeam Systems at Ka-Band", "ISART", Sep. 6, 2000, pp. 1-24, Publisher: Saab Ericsson Space, Published in: Boulder, Colorado.

Williams et al., "Communications Satellite Antennas With On-Orbit Pattern Flexibility", "Microwave Journal", Aug. 2004, pp. 1-8, Publisher: Horizon House Publications, Inc.

Wyman L. Williams, "Advance Lightweight Electronically Steered Antennas for Responsive Space Payloads", Apr. 1-3, 2003, pp. 1-11, Publisher: 1st Responsive Space Conference, Published in: Redondo Beach, CA.

Elliot, et al., "Multiple-Beam Low-Profile Low-Cost Antenna", "2013 IEEE International Symposium on Phased Array Systems and Technology",Oct. 15, 2013 , pp. 285-292.

Sangawa, et al., "A Ka-Band High-Efficiency Dielectric Lens Antenna With a Silicon Micromachined Microstrip Patch Radiator", "IEEE", Jan. 1, 2001, pp. 389-392, Publisher: 2001 IEEE MTT-S Digest.

Sazonov, et al., "Optimal Dielectric Lens Antennas With One or Two Homogenious Sperical Layers", "IEEE Xplore", Sep. 13, 1999, pp. 183-184, Publisher: Proceedings of 9th Internationla Calmean Microwave Conference, Published in: Ukraine.

Schoenlinner et al., "Compact Multibeam Imaging Antenna for Automotive Radars", "IEEE MTT-S Digest", May 2, 2002, pp. 1373-1376.

Schoenlinner, et al., "Wide-Scan Spherical-Lens Antennas for Automotive Radars", Sep. 1, 2002, pp. 2166-2175, vol. 5, No. 9, Publisher: IEEE Transactions on Microwave Theropy and Techniques.

European Patent Office, "Office Action from EP Application No. 15189447.4 dated Mar. 4, 2018"; "from Foreign Counterpart of U.S. Appl. No. 14/621,997"; dated Mar. 4, 2018, pp. 1-8; Published in: EP.

* cited by examiner

MULTIPLE BEAM ANTENNA SYSTEMS WITH EMBEDDED ACTIVE TRANSMIT AND RECEIVE RF MODULES

CROSS-REFERENCE TO RELATED APPLICATIONS

This application is a non-provisional application claiming priority to, and the benefit of, U.S. Provisional Application 62/066,149, entitled "A MULTIPLE BEAM ANTENNA WITH SPHERICAL LENS AND EMBEDDED ACTIVE TRANSMIT AND RECEIVE RF MODULES", filed on Oct. 20, 2014 and which is incorporated herein by reference in its entirety.

BACKGROUND

Passive antennas and feeds have been used to enable switched multiple beam antennas for use in applications such as datalinks between aircraft where each aircraft is equipped with such an antenna. For example, such antennas are capable of producing agile electronically switched beams using ferrite switching circulators at microwave or millimeter wave frequencies. However, these antennas have inherent limitations due to their architecture and radio frequency (RF) components used in the antenna, including RF signal loss due to Ohmic losses in the antenna components and transmission lines, connection losses between the antenna and the datalink radio, and loss of gain between the discrete beam directions associated with the feed locations. These RF losses impact the performance of the antennas in a negative manner, particularly in many applications that desire higher effective antenna gains to achieve specific performance associated with separation range or communication data rates.

For the reasons stated above and for other reasons stated below which will become apparent to those skilled in the art upon reading and understanding the specification, there is a need in the art for improved systems and methods for multiple beam antennas.

SUMMARY

The Embodiments of the present invention provide improved systems and methods for multiple beam antennas and will be understood by reading and studying the following specification.

Multiple beam antenna systems with embedded active transmit and receive RF modules are provided. In one embodiment, an active multiple beam antenna system includes: a spherical lens; a plurality of planar multi-feed assemblies spaced around a region of the spherical lens, wherein each of the planar multi-feed assemblies comprises: a plurality of feeds spaced around and directed into the spherical lens; a plurality of transmit/receive active modules, wherein one respective transmit/receive active module of the plurality of transmit/receive active modules is coupled to each of the plurality of feeds; a first power divider coupled to each of the plurality of transmit/receive active modules; and a second power divider coupled to the first power divider of each of the plurality of planar multi-feed assemblies, the first power divider further configured to couple with a datalink radio.

DRAWINGS

Embodiments of the present invention can be more easily understood and further advantages and uses thereof more readily apparent, when considered in view of the description of the preferred embodiments and the following figures in which.

In accordance with common practice, the various described features are not drawn to scale but are drawn to emphasize features relevant to the present invention. Reference characters denote like elements throughout figures and text.

DETAILED DESCRIPTION

Figure 1:
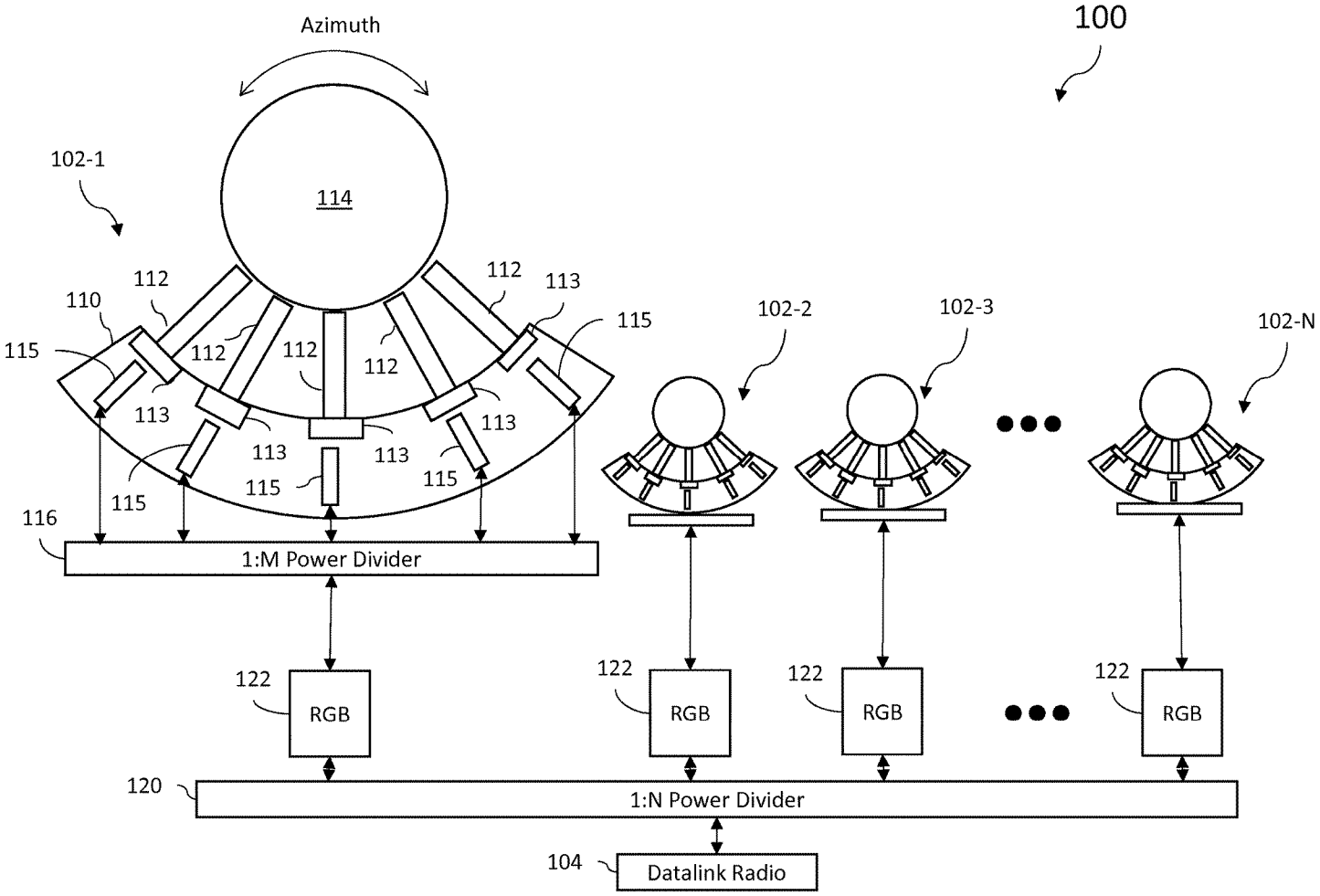
FIGS. 1 and 1A are diagrams illustrating an Active Multiple Beam Antenna System of one embodiment of the present disclosure.

In the following detailed description, reference is made to the accompanying drawings that form a part hereof, and in which is shown by way of specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

Embodiments of the present disclosure provide system and methods that overcome the losses associated with passive multiple beam antennas by introducing a plurality of transmit/receive ("T/R") active modules, one at each feed of a multiple beam antenna. Introducing a T/R active module at each feed enables flexible control and utilization of individual feeds. For example, an antenna based on embodiments of the present disclosure, using T/R active modules at each feed, can be configured to radiate or receive from a single feed at a time which results in a switched multiple beam antenna with improved performance as compared to a passive antenna. Such an active multiple beam antenna achieves this agile beam performance without the need for RF phase shifters as might be needed in a phased array antenna. Alternatively, the antenna can be configured to radiate from a specified subset of feeds in proximity to each other, to create a combined beam that enables RF beam shaping with improved gain characteristics. Embodiments presented herein also enable the antenna to readily switch between transmit and receive modes in a half duplex mode characteristic of datalink antennas. Multiple beam antenna design is also simplified and performance improved because the use of waveguide and ferrite switch elements between transmitter/receiver electronics and the antenna's feeds can be avoided. Finally, Ohmic losses are minimized by providing a power amplifier (PA) that feeds into each feed located in proximity during transmit mode operation, and a low noise amplifier (LNA) that receives RF signals from each feed located in proximity in receive mode operation.

Embodiments discussed herein thus provide considerable flexibility in the use of the antenna with discrete antenna beams from individual feed excitation but also a wide variety of options from multiple feed excitations. Multiple feed excitations can be utilized to improve performance as compared to single beam performance between discrete beams, as well as increase the beam coverage solid angle. An increased beam coverage solid angle allows for wider latitude of relative angular movement between two such antennas used for communication on dynamic and moving platforms such as aircraft all while maintaining sufficient gain.

One or more embodiments presented in this disclosure use a spherical lens as a common element for all feeds. The use of a spherical lens results in an approximate uniform performance for all feeds. A preferred embodiment of the spherical lens is further a single spherical dielectric (i.e. constant-K lens) of a specified permittivity, diameter and feed separation to achieve a desired antenna characteristic such as gain and beamwidth. Further embodiments of the spherical lens includes multiple spherical dielectric shells to achieve antenna characteristics not achievable with a single dielectric.

In one embodiment, the feeds for the multiple beam antenna utilize a circular waveguide and more generally a dielectrically loaded waveguide to allow close proximity of adjacent feeds to allow close beam spacings. Furthermore, such feeds allow for the embodiment of a waveguide polarization conversion from linear to a desired circular polarization. Other embodiments of the feed can use alternate methods of size reduction including the use of ridge loading of a circular waveguide.

Connectivity of a T/R module to the feeds may be accomplished in a variety of techniques that allow for low loss and well matched transitions between transmission media of the feed and the T/R module interface. For example, in one embodiment, a T/R module may include microstrip transmission line feeds at a package interface and use intermediate transmission media including waveguide and microstrip to facilitate an efficient and convenient transition to the antenna feeds. Other embodiments can use multilayer stripline to realize an efficient and convenient transition.

Figure 1A:
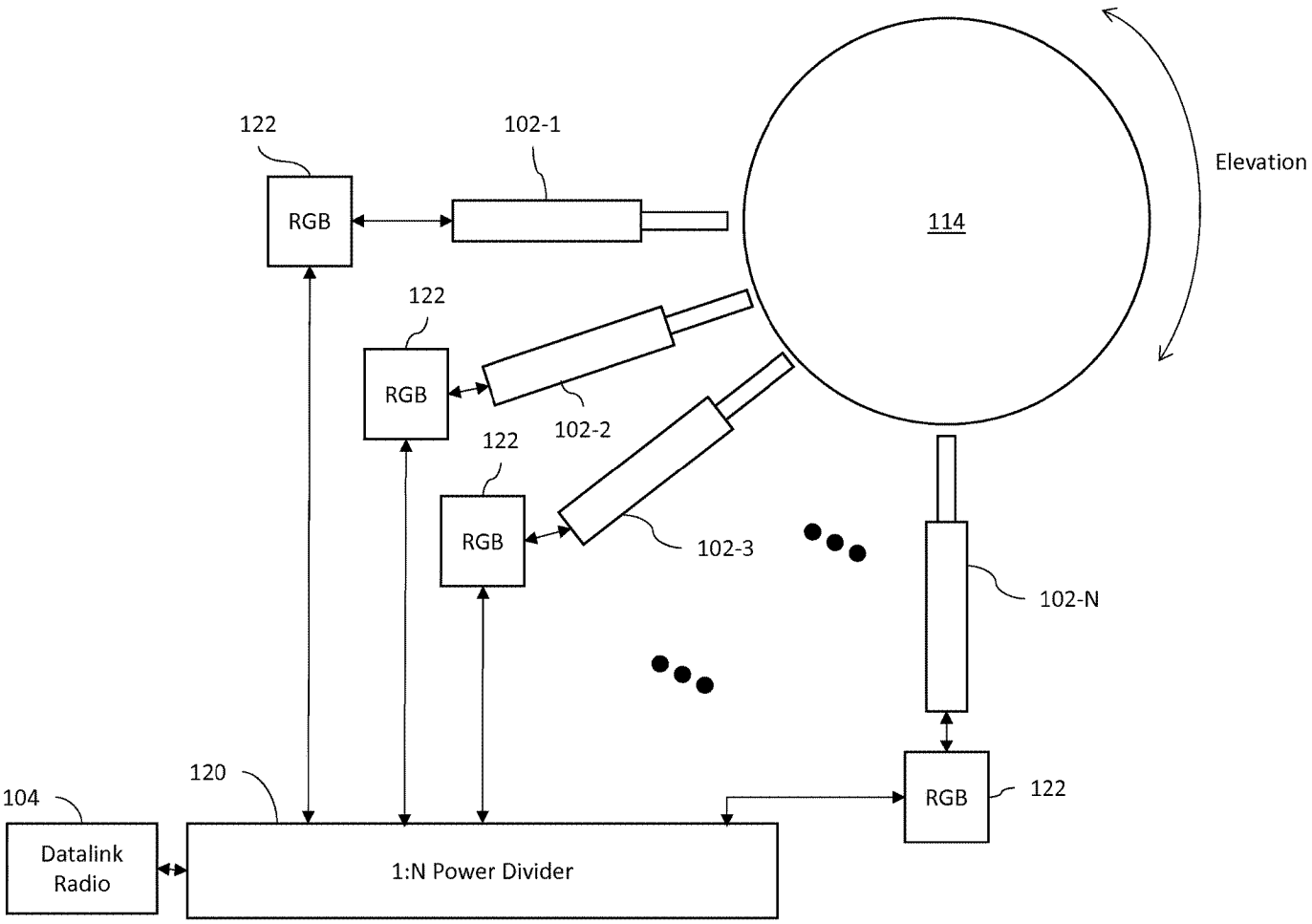

FIGS. 1 and 1A are diagrams illustrating an Active Multiple Beam Antenna System 100 of one embodiment of the present disclosure. System 100 comprises a plurality of planar multi-feed assemblies (shown at 102-1 to 102-N, where N≥1) arranged around a spherical lens 114. Although this description describes in detail a first planar multi-feed assembly 102-1 of the plurality, it should be appreciated that where N>1 this description of planar multi-feed assembly 102-1 applies to the structure and function of each of the other planar multi-feed assemblies 102-2 to 102-N. As shown in FIGS. 1 and 1A, active multiple beam antenna system 100 further can comprise a 1:N power divider 120 coupled on its N-port side to each of the N planar multi-feed assemblies 102-1 to 102-N and coupled on its 1-port side to a datalink radio 104. Of course, in the simplest embodiment where N=1, only a single planar multi-feed assembly is used and the power divider 120 may be omitted. Datalink radio 104 may comprise either a single band, or multi-band, transceiver that operates in half-duplex. That is, in operation, datalink radio 104 operates at any one time in either a transmit mode in which case system 100 transmits RF signals, or a receive mode in which it receives RF signals from system 100. In one embodiment, datalink radio 104 is configured so that system 100 operates in microwave/millimeter wave radio frequencies.

It should be noted that the term "power divider" as used in this disclosure refers to an element that functions as both a power divider and power combiner depending on the direction of power flow. In one embodiment in operation, an RF signal transmitted by datalink radio 104 is transmitted to power divider 120 and distributed to one or more of the N planar multi-feed assemblies 102-1 to 102-N. Alternately, RF signals received by power divider 120 from one or more of the N planar multi-feed assemblies 102-1 to 102-N are combined and passed through to the datalink radio 104. In some embodiments, a reciprocal gain block (RGB) 122 is coupled between each of the planar multi-feed assemblies 102-1 to 102-N and the power divider 120. That is, each one of the N planar multi-feed assemblies 102-1 to 102-N is individually coupled to the power divider 120 via an intervening reciprocal gain block 122. The function of the reciprocal gain block 122 is addressed later in this disclosure. In one embodiment, spherical lens 114 is implemented using a constant K dielectric lens which has the property of focusing a beam in a specified direction from a feed point either on the surface of the lens or a short distance therefrom.

As illustrated generally by planar multi-feed assembly 102-1, each of the planar multi-feed assemblies 102-1 to 102-N comprises a plurality of feeds 112 each directed to the center of spherical lens 114. Planar multi-feed assembly 102-1 comprises M feeds 112, where M>1. The other assemblies 102-1 to 102-N may also comprise M feeds, or each may comprise a different number of feeds compared to assembly 102-1.

Each of the feeds 112 is coupled to a respective individual T/R active module 115 which is dedicated to operation of exactly one feed 112. In some embodiments, the feeds 112 and T/R active modules 115 may be placed about lens 114 at approximately a constant angular separation. In alternate embodiments, the feeds 112 may each comprise circular waveguides, or comprise waveguides of some other shape. In some embodiments, feeds 112 may comprise dielectric filled waveguides or a ridged loading to reduce the size of the cross section. Polarization may be circular to easily allow a communication link to be established between two such antennas with minimal polarization mismatch loss in a dynamic environment.

In the embodiment shown in FIG. 1, the plurality of M T/R active modules 115 are integrated into a structure 110 incorporating an efficient transition adapter 113 between the feed 112 and the T/R active module 115. In one embodiment, structure 110 incorporates bias voltage and control lines to allow turning on and off components within the T/R active modules 115 and control of the active power divider 116 (described below) thus enabling switching of the RF signal at each individual feed 112. Each of the feeds 112 are coupled to their respective T/R active module 115 by a feed to T/R active module transition adapter 113, which may use a variety of transmission media including waveguide, microstrip and stripline within the structure 110. In one embodiment, the structure 110 comprises a metallic housing made of aluminum. The metallic structure 110 may, in some embodiments, also serve as a heat sink for amplifiers in the T/R active modules 115. Further, in some embodiments, T/R active module 115 integration into the structure 110 provides for interfacing control circuitry to the T/R active modules in addition to interfacing with the feeds 112.

In the embodiment shown in FIG. 1, each of the planar multi-feed assemblies 102-1 to 102-N further comprise a power divider 116 (shown as a 1:M power divider for assembly 102-1). Power divider 116 may also be integrated into the structure 110 and in some embodiments comprises an active power divider. When datalink radio 104 is operating in transmitter mode, power divider 116 distributes the RF signal received from datalink radio 104 to the plurality of T/R active modules 115 in its planar multi-feed assembly. Similarly, when datalink radio is operating in receiver mode, any RF signals received by power divider 116 from one or more of the T/R active modules 115 in its structure 110 are combined and passed through to the power divider 120, and then to datalink radio 104.

Further as shown in FIG. 1, each of the planar multi-feed assemblies 102-1 to 102-N may be coupled to the power divider 120 via a reciprocal gain block (RGB) 122. Each RGB 122 effectively functions as a switchable dual directional amplifier. More specifically, each RGB 122 switches between transmit and receive modes as the datalink radio 104 switches between transmit and receive mode. Further, each RGB 122 may be individually operated to turn on or off depending on which feeds 112 are selected to be used. For example, the RGB 122 coupled to planar multi-feed assemblies 102-1 may remain off, not passing RF signals between planar multi-feed assembly 102-1 and power divider 120, unless one of the feeds 112 in planar multi-feed assembly 102-1 has been selected for use (either in transmit or receive mode). Then when at least one of the feeds 112 in planar multi-feed assembly 102-1 is selected, that associated RGB 122 becomes operable and switches to the same operating mode as the selected feed 112. For example, in one embodiment, when one of the T/R active modules 115 is activated to transmit into its feed 112, the RGB 122 for that planar multi-feed assembly turns on and switches to transmit mode. When one of the T/R active modules 115 is instead activated to receive from a feed 112, the RGB 122 for that planar multi-feed assembly turns on and switches to receive mode. In alternate implementations, an RGB 122 may comprise a discrete element, such as shown in FIG. 1, or instead may be embedded or integrated into either power divider 116 or power divider 120. In this way, by appropriate operation of T/R active modules 115 and RGBs 122, an individual feed 112, or a subset of the total number of feeds 112 available in antenna system 100, can thus be selected for either transmit or receive.

Figure 2:
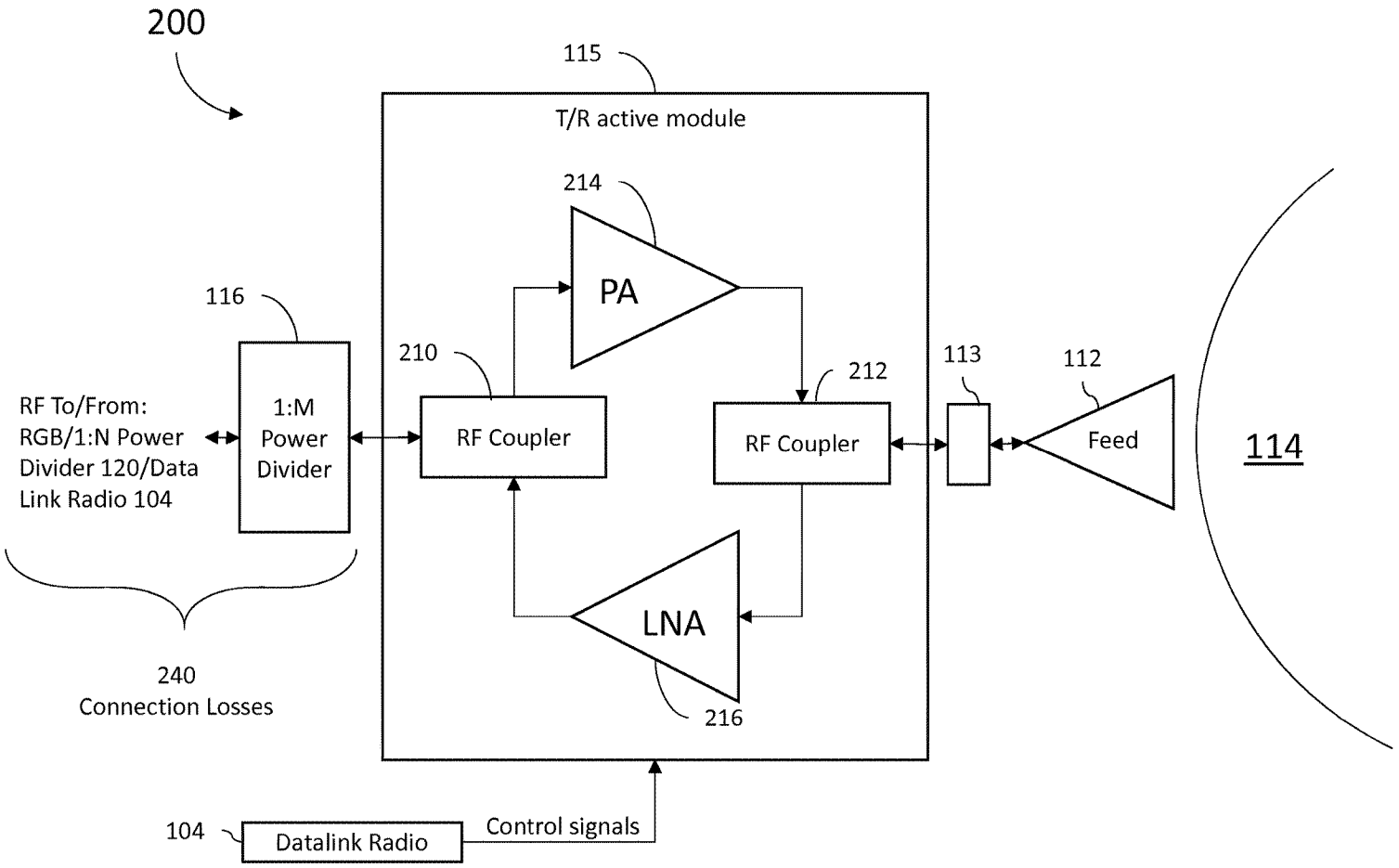
FIG. 2 is a diagram illustrating a Transmit/Receive Active Module of one embodiment of the present disclosure.

FIG. 2 is a schematic diagram illustrating generally at 200 a T/R active module 115 of one embodiment of the present disclosure. T/R active module 115 essentially functions within system 100 as an embedded dual directional amplifier. One notable difference between a T/R active module and an RGB is the desired output power of the transmit amplifier of the T/R active module is generally greater than the RGB and the noise figure of the receive amplifier of the T/R active module is generally greater than that of the RGB. As shown in FIG. 2, each T/R active module 115 comprises a power amplifier (PA) 214 and low noise amplifier (LNA) 216. In some embodiments, one or both of PA 214 and LNA 216 may be implemented using Gallium Nitride (GaN) amplifiers or Gallium Arsenide (GaAs) amplifiers. In other embodiments, other amplifier technologies may be used. The PA 214 and LNA 216 are coupled to power divider 116 by a first RF coupler 210 and to transition adapter 113 and then feed 112 by a second RF coupler 212. In one embodiment, RF couplers 210 and 212 are active switches. In such an embodiment, when transmitting an RF signal from feed 112, RF coupler 210 and 212 are both switched to PA 214. Any RF signal received from datalink radio 104 is routed by coupler 210 to the PA 214. That RF signal, which is amplified by PA 214 for wireless transmission, is then switched by RF coupler 212 into the transition adapter 113 and then feed 112. When receiving an RF signal from feed 112, RF couplers 210 and 212 are both switched to LNA 216. The received RF signal from transition adapter 113 and feed 112 is switched to LNA 216 (and amplified with low noise) and then switched out to datalink radio 104. In one embodiment, the state of RF couplers 210 and 212, when they implemented as active switches, are toggled by control wires, which as mentioned above may be embedded within components of the structure 110. In one such embodiment where RF couplers 210 and 212 are implemented as active switches, each may comprise field effect transistor (FET) type switches. Another such embodiment is where the RF couplers 210 and 212 are implemented with PIN diodes.

In other implementations, RF couplers 210 and 212 may instead be implemented using microstrip or stripline ferrite circulators that do not toggle between states. That is, when implemented as ferrite circulators, the RF coupler 212 is configured in a clockwise manner to provide a low loss path from the PA 214 to the transition adapter 113 and simultaneously to provide a low loss path from transition adapter 113 to the LNA 216. The ferrite circulator at RF couple 210 is similarly configured to provide a low loss path from power divider 116 to PA 214 and simultaneously from LNA 216 to power divider 116.

In other embodiments, the operating state of T/R active module 115 may also be controlled so that PA 214 is only operable when datalink radio 104 is operating in transmitter mode and feed 112 is selected to transmit the signal. For example, bias voltages applied to PA 214 may be controlled to shut off PA 214 except when its associated feed 112 has been selected to transmit. In this way, RF energy transmissions from antenna system 100 can be directed in a particular direction, by controlling individual PA 214's so that only a subset of the total number of feeds is energized. Similarly, T/R active module 115 may be controlled so that LNA 216 is only operable when datalink radio 104 is switched to receiving mode. For example, bias voltages applied to LNA 216 may be controlled to shut off the amplifier whenever PA 214 (or the PA for any other of the feeds in system 100) is turned on. In other implementations, the LNAs 216 for only a subset of the total number of feeds in system 100 are made operable, with the others shut off, so that system 100 is sensitive to incoming RF signals coming from a specific direction, but not others.

With the embodiments describe herein, the T/R active module 115 are located at a forward position in the antenna architecture, immediate coupled to the antenna feeds 112 via a transition adapter 113. Rather than having a single T/R amplifier assembly for the entire antenna system 100, there are multiple modules, one for each feed 112 of the antenna system 100. The proximity of the T/R active modules 115 to the antenna feeds 112 results in minimal losses for signal transmitted from the PA 214 and for similar minimal loss in signals received at the LNA 216.

Further, by controlling the RGBs 122 at each assembly 102-1 to 102-N, only those assemblies having feeds actually needed for transmitting or receiving a signal are electrically connected to the datalink radio 104, further avoiding sources of intervening signal losses between the datalink radio 104 and the selected feed(s) 112.

Figure 3:
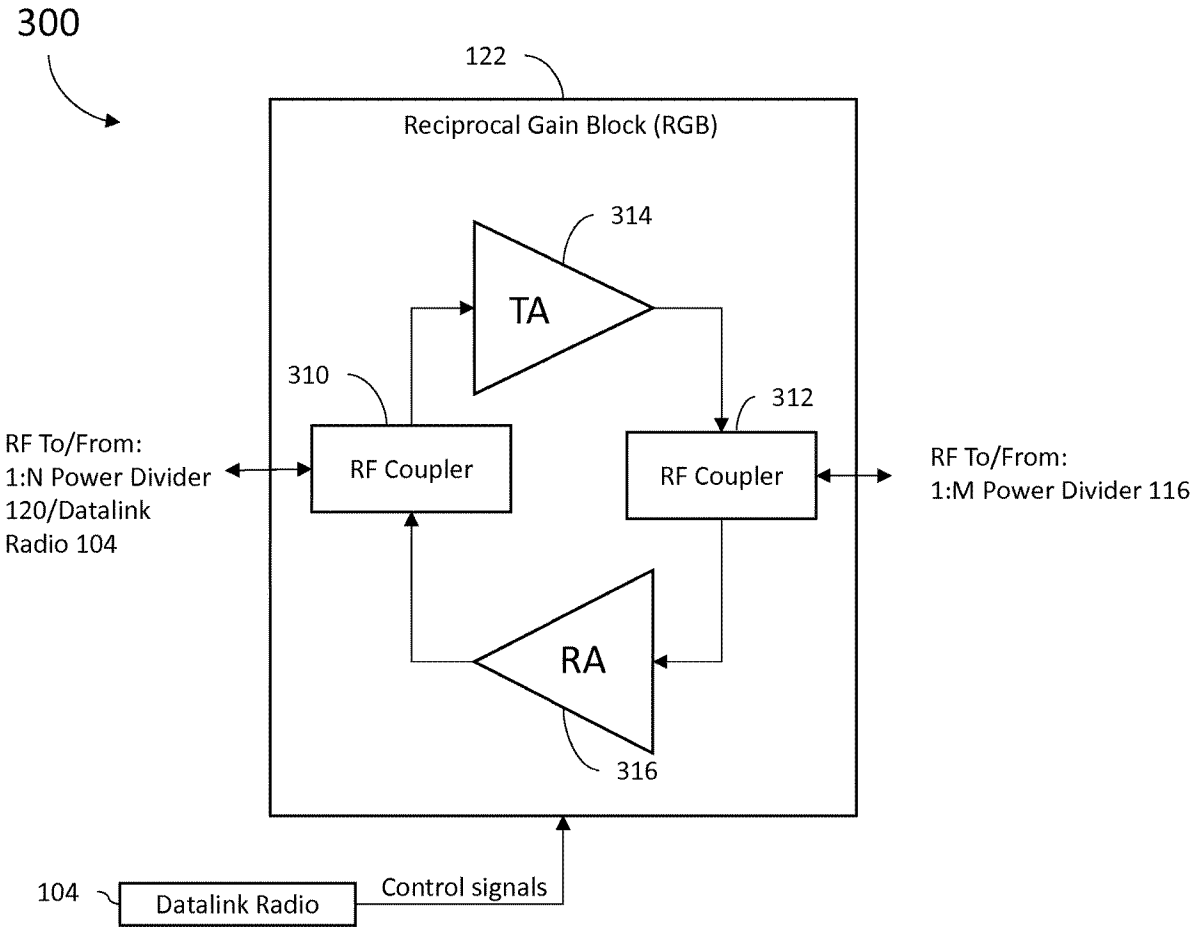
FIG. 3 is a diagram illustrating a Reciprocal Gain Block of one embodiment of the present disclosure.

FIG. 3 is a schematic diagram illustrating generally at 300 a reciprocal gain block 122 of one embodiment of the present disclosure. In the embodiment shown in FIG. 3, RGB 122 comprises a transmit mode amplifier (TA) 314, and a receive mode amplifier (RA) 316, and first and second RF couplers 310 and 312. In some embodiments, one or both of TA 314 and RA 316 may be implemented using Gallium Nitride (GaN) amplifiers or Gallium Arsenide (GaAs) amplifiers. In other embodiments, other amplifier technologies may be used. In one embodiment, depending on the transmit or receive operating mode, RF couplers 310 and 312 are implemented as switches and operated to switch between TA 314 and RA 316. In one embodiment, the state of RF couplers 310 and 312, when implemented as active switches, is toggled using control wires. In one such embodiment RF couplers 310 and 312 may each comprise field effect transistor (FET) type switches. Another such embodiment is where the RF couplers 310 and 312 are implemented with PIN diodes.

TA 314 may be implemented as a lower gain power amplifier (that is, a lower gain relative to the gain of PA 214). TA 316 may be implemented as a lower gain low noise amplifier (that is, a lower gain relative to the gain of LNA 216). For example, in one embodiment, an RGB 122 provides for a gain of approximately 20 dB in either transmit or receiving mode. The output power of TA 314 of the RGB is generally less than the T/R active module PA 214 and similarly the noise figure of RA 316 is generally greater than that of the T/R active module LNA 216.

In other implementations, RF couplers 310 and 312 may instead be implemented using microstrip or stripline ferrite circulators that do not toggle between states. That is, when implemented as ferrite circulators, the RF coupler 312 is configured in a clockwise manner to provide a low loss path from the PA 314 to the output power divider 116 and simultaneously to provide a low loss path from RA 316 to RF coupler 310 and then the input power divider 120.

As evident from the illustrations in FIGS. 1 and 1A, two degrees of freedom in polar dimensions are afforded for selecting a gain pattern for antenna system 100 in a desired direction. For example, the selection of one of the planar multi-feed assemblies 102-1 to 102-N arranged around lens 114 may be used to select the elevation angle as shown in FIG. 1A that is used for transmitting or receiving a RF signal. The selection of the particular feed 112 on that particular assembly would then be used to select the azimuth angle as shown in FIG. 1 that is used for transmitting or receiving a RF signal. It is clear that azimuth and elevation only refer to a specific configuration and may be used more generally to indicate the two degrees of angular freedom in pointing a particular beam. In one embodiment, control signals originating from the datalink radio 104 are provided to the various T/R active modules 115 and reciprocal gain blocks 122 within antenna system 100 to control switch states and/or amplifier bias voltages in the manner described above. Through these control signals from datalink radio 104, the selection and operation of specific feeds 112 may be achieved. In some embodiments, antenna system 100 is used at millimeter wave frequencies using multiple feeds (for example 40 feeds) to provide coverage over a π steradian coverage. Two such configurations of system 100 as shown in FIGS. 1 and 1A may be combined to provide approximate hemispherical coverage, and four combined to provide for a full 4π steradian spherical coverage.

It should be appreciated that a normalized signal to noise ratio for a signal transmitted between two antenna systems 100 such as shown in FIGS. 1 and 1A can be expressed by:

$$\frac{S}{N} kB\, L_s T_o \frac{1}{D^2} = \frac{P_t}{L}\frac{1}{FL}$$

where, $$\frac{S}{N} = \text{signal to noise ratio},$$

$P_t$ = tranmitter power, $F = LNA$ noise temperature

-continued $L$ = receive loss = transmit loss, $D$ = receive directivity = transmit directivity, $T_o$ = temperature looking into hot Earth, $$L_s = \text{space loss} = \left[4\pi\frac{r}{\lambda}\right]^2,$$

$k$ = Boltzman's constant = −228.6 dB/Hz (i.e. 1.38 $10^{-23}$ J/K), and $B$ = signal bandwidth (Hz).

As such, constancy of antenna system performance may be maintained by maintaining the constancy of this expression as the various design parameters are considered. These design parameters include the output power of PA 214, the noise figure of LNA 216 and loss of the transitions 113, antenna feed 112, and lens 114. Alternately, if this normalized ratio is greater than some baseline, antenna system performance will be improved as manifested in increased range or system bandwidth i.e. data rate.

Figure 4:
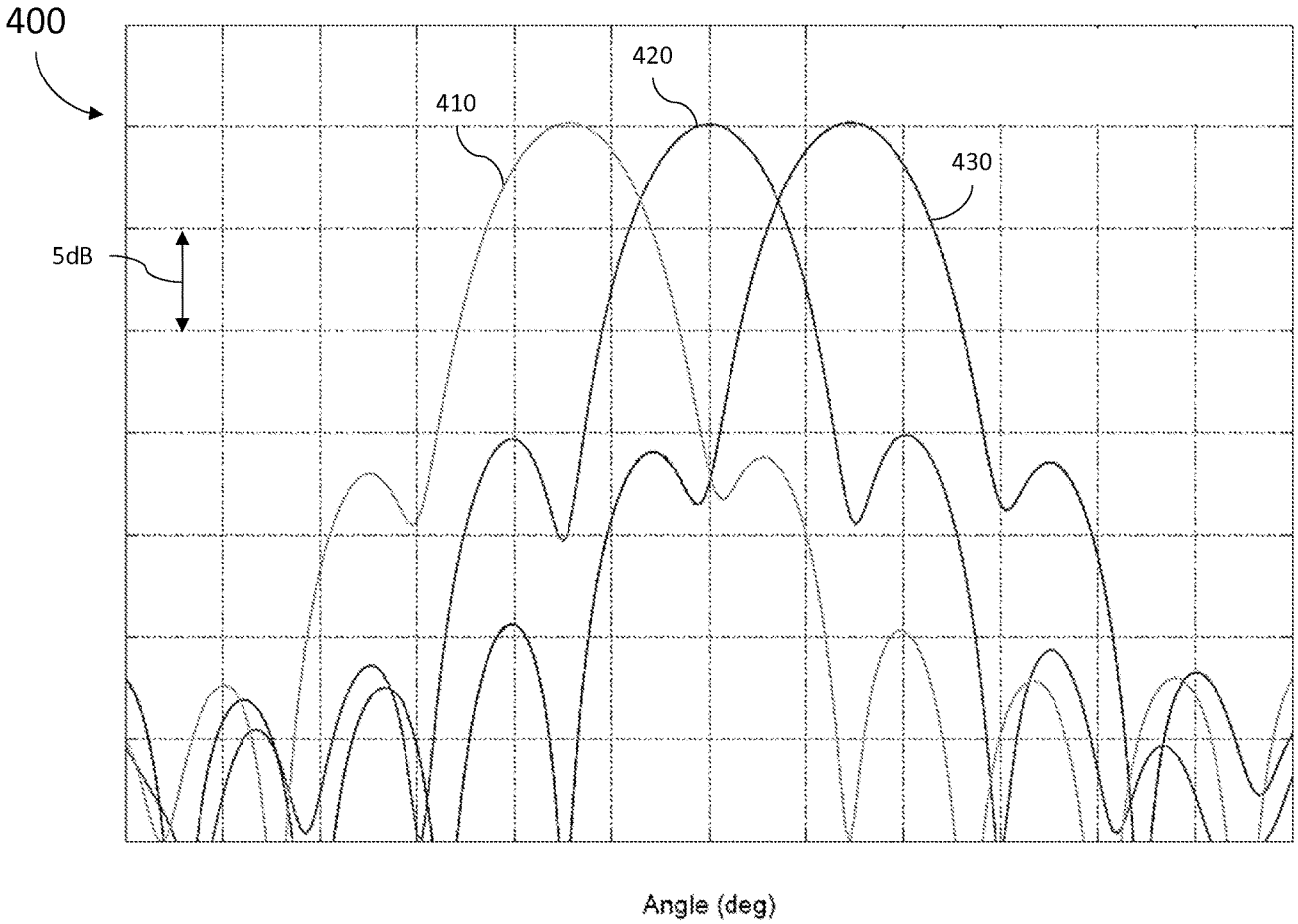
FIG. 4 is a diagram illustrating antenna radiation patterns for individual feeds of one embodiment of the present disclosure.
Figure 5:
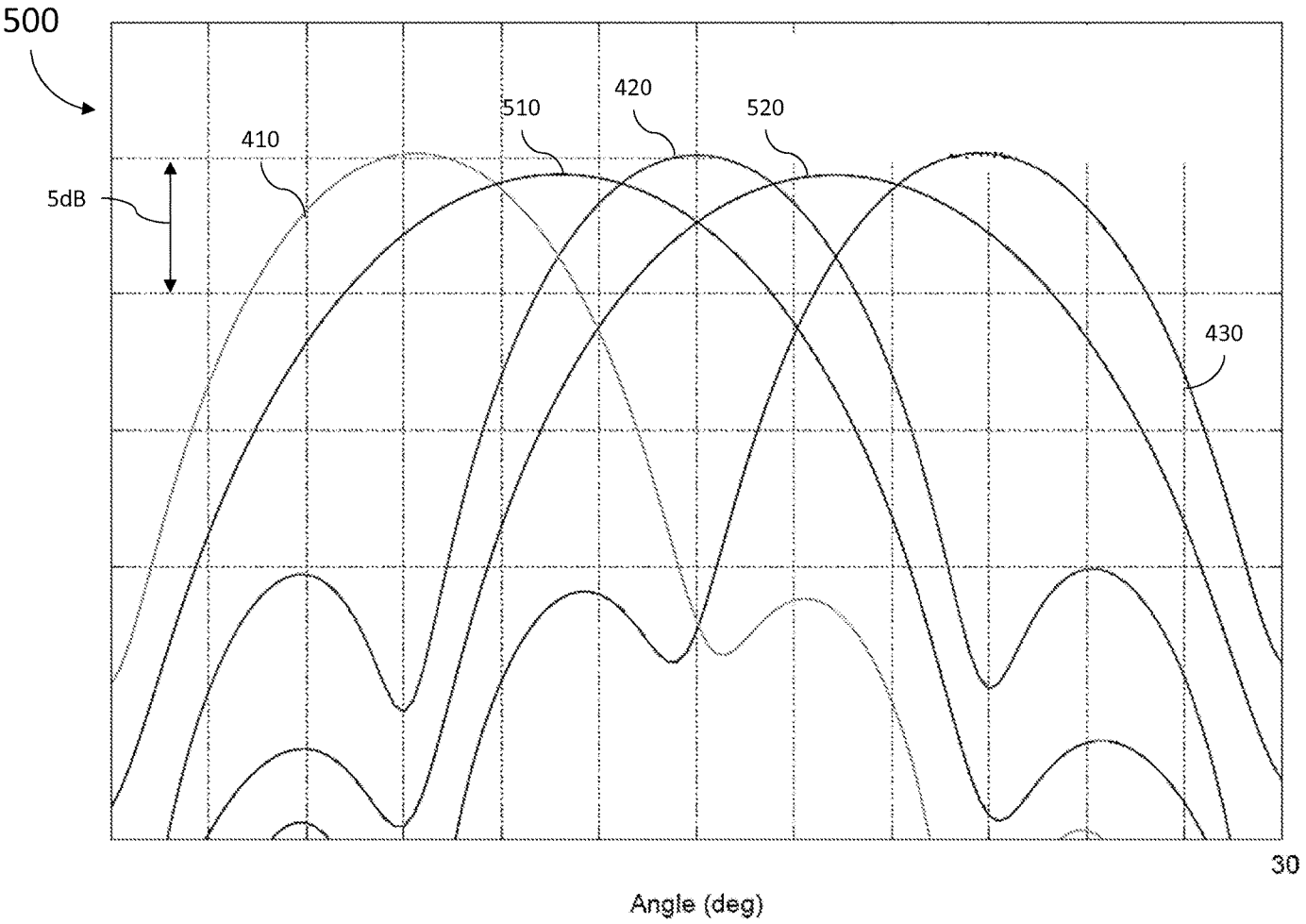
FIGS. 5 and 6 are diagrams illustrating antenna radiation patterns with beam combining for one embodiment of the present disclosure.
Figure 6:
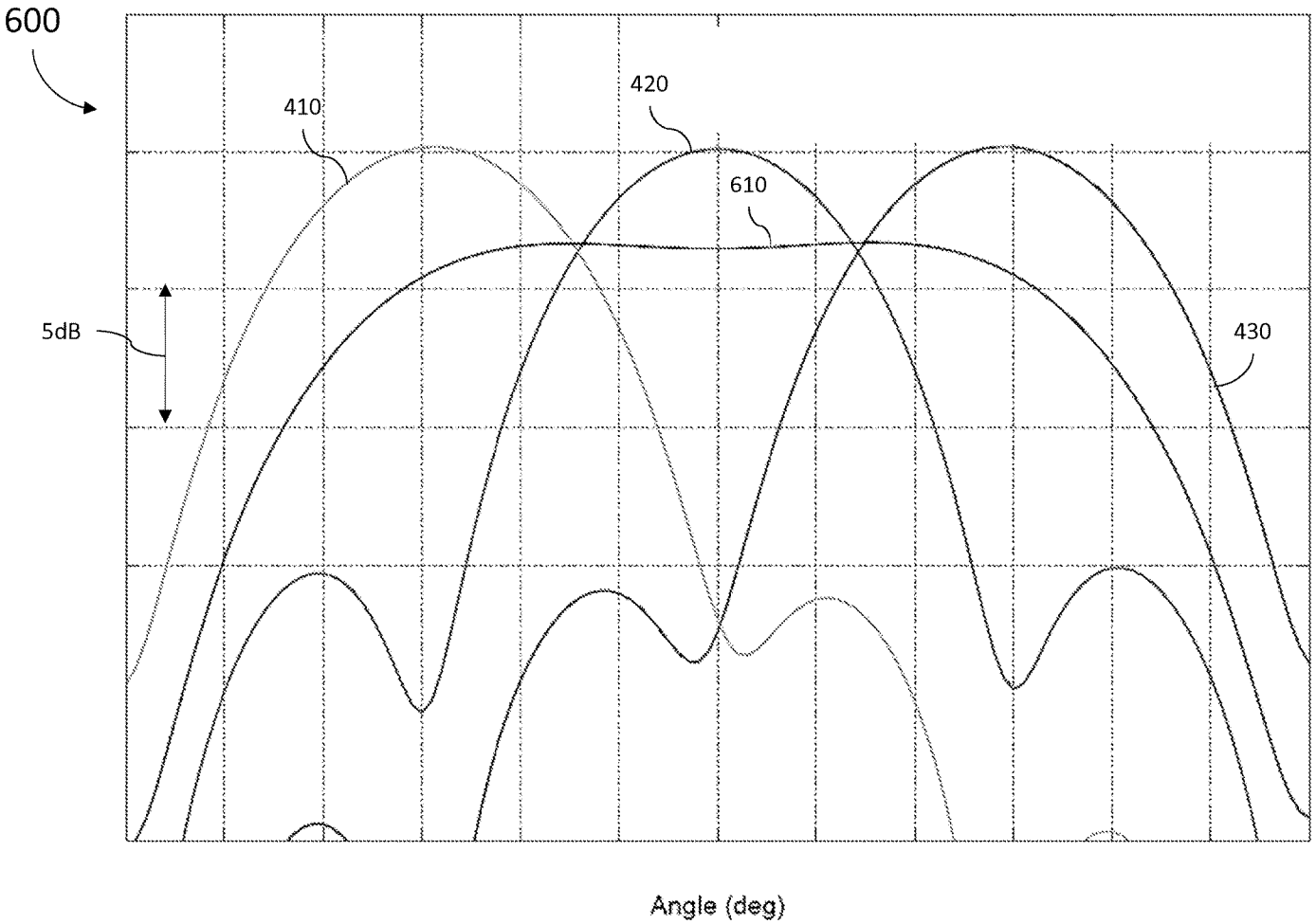

Besides minimizing Ohmic losses, another benefit presented in embodiments of the present disclosure is that multiple feeds of any configuration can be used simultaneously to the advantage of the antenna. The excitation of multiple feeds provides improvements in the gain between discrete beam peaks but also increases the transmit power, thus increasing the effective radiated power. For example, FIG. 4 illustrates at 400 overlaid computed radiation patterns 410, 420 and 430 associated with individual beams for respective individual feeds turned on one at a time. Next, FIG. 5 illustrates at 500 two cases when two neighboring feeds are turned on at the same time. For example, computed radiation pattern 510 illustrates the beam formed from the combination of 410 and 420 (i.e., when the feeds producing 410 and 420 are turned on simultaneously). Similarly, computed radiation pattern 520 illustrates the beam formed from the combination of 420 and 430 (i.e., when the feeds producing 420 and 430 are turned on simultaneously). Finally, FIG. 6 illustrates at 600 a computed radiation pattern 610, a beam formed from the combination of 410, 420 and 430 (i.e., when the feeds producing 410, 420 and 430 are turned on simultaneously). This implementation enables a configuration where all the transmitted power can be concentrated in just three specific feeds, but obtains a wider angle of coverage than a single beam. Further, when a spread radiation pattern such as 610 is used as a near horizon beam, the directionality of the beam pattern need not be as precise because it is sensitive over a larger angular area.

EXAMPLE EMBODIMENTS

Example 1 includes and an active multiple beam antenna system, the system comprising: a spherical lens; a plurality of planar multi-feed assemblies spaced around a region of the spherical lens, wherein each of the planar multi-feed assemblies comprises: a plurality of feeds spaced around and directed into the spherical lens; a plurality of transmit/receive active modules, wherein one respective transmit/receive active module of the plurality of transmit/receive active modules is coupled to each of the plurality of feeds; a first power divider coupled to each of the plurality of transmit/receive active modules; and a second power divider coupled to the first power divider of each of the plurality of planar multi-feed assemblies, the first power divider further configured to couple with a datalink radio.

Example 2 includes the system of example 1, further comprising: a plurality of reciprocal gain blocks, wherein each one of the plurality of reciprocal gain blocks are coupled between the first power divider of a respective planar multi-feed assembly and the second power divider.

Example 3 includes the system of example 2, wherein a first reciprocal gain block of the plurality of reciprocal gain blocks comprises: a transmit amplifier coupled between a first RF coupler and a second RF coupler; and a receive amplifier coupled between the first RF coupler and the second RF coupler; wherein the first RF coupler is further coupled to the first power divider and the second RF coupler is further coupled to the second power divider.

Example 4 includes the system of example 3, wherein the plurality of reciprocal gain blocks each receive a control signal originating from the datalink radio, wherein an operating state of one or both of the transmit amplifier and the receive amplifier are controlled based on the control signal.

Example 5 includes the system of example 4, wherein reciprocal gain blocks each receive a control signal originating from the datalink radio, wherein an operating state of one or both of the first RF coupler and the second RF coupler are controlled based on the control signal.

Example 6 includes the system of any of examples 2-5, wherein the active multiple beam antenna system is configured to select an RF signal in a specified direction by controlling which of the plurality of transmit/receive active modules are in an operable state, and which of the plurality of reciprocal gain blocks are in an operable state.

Example 7 includes the system of any of examples 1-6, wherein a first of transmit/receive active module of the plurality of transmit/receive active modules comprises: a power amplifier coupled between a first RF coupler and a second RF coupler; and a low noise amplifier coupled between the first RF coupler and the second RF coupler; wherein the first RF coupler is further coupled to the first power divider and the second RF coupler is further coupled to a feed of the plurality of feeds spaced around and directed into the spherical lens.

Example 8 includes the system of example 7, wherein the plurality of transmit/receive active modules each receive a control signal originating from the datalink radio, wherein an operating state of one or both of the power amplifier and the low noise amplifier are controlled based on the control signal.

Example 9 includes the system of any of examples 7-8, wherein the plurality of transmit/receive active modules each receive a control signal originating from the datalink radio, wherein an operating state of one or both of the first RF coupled and the second RF coupler are controlled based on the control signal.

Example 10 includes the system of any of examples 1-9, wherein the plurality of feeds each comprise a dielectric filled circular waveguide.

Example 11 includes the system of any of examples 1-10, wherein each of the plurality of planar multi-feed assemblies further comprises a structure that further comprises the plurality of transmit/receive active modules.

Example 12 includes the system of example 11, wherein the plurality of planar multi-feed assemblies further comprise a plurality of feed to T/R active module transition adapters, where each of the plurality of feeds spaced around and directed into the spherical lens is coupled to a respective one of the plurality of transmit/receive active modules by one of the feed to T/R active module transition adapters.

Example 12 includes the system of any of examples 1-12, wherein the active multiple beam antenna system is configured to select an RF signal in a specified direction by controlling which of the plurality of transmit/receive active modules are in an operable state.

Example 14 includes a planar multi-feed assembly for an active multiple beam antenna system, the planar multi-feed assembly comprising: a plurality of feeds spaced around and directed into a spherical lens; a plurality of transmit/receive active modules, wherein one respective transmit/receive active module of the plurality of transmit/receive active modules is coupled to each of the plurality of feeds; a first power divider coupled to each of the plurality of transmit/receive active modules; and a reciprocal gain block coupled to the first power divider.

Example 15 includes the planar multi-feed assembly of example 14, wherein the reciprocal gain block is coupled to a second power divider, wherein the second power divider is further coupled to a plurality of additional planar multi-feed assemblies and a datalink radio.

Example 16 includes the planar multi-feed assembly of any of examples 14-15, wherein the reciprocal gain block comprises: a transmit amplifier coupled between a first RF coupler and a second RF coupler; and a receive amplifier coupled between the first RF coupler and the second RF coupler; wherein the first RF coupler is further coupled to the first power divider and the second RF coupler is further coupled to the second power divider.

Example 17 includes the planar multi-feed assembly of any of examples 14-16, wherein the transmit/receive active module comprises: a power amplifier coupled between a first RF coupler and a second RF coupler; and a low noise amplifier coupled between the first RF coupler and the second RF coupler; wherein the first RF coupler is further coupled to the first power divider and the second RF coupler is further coupled to a first feed of the plurality of feeds spaced around and directed into the spherical lens.

Example 18 includes the planar multi-feed assembly of any of examples 14-17, further comprising: a structure that further comprises: the plurality of transmit/receive active modules; and a plurality of feed to T/R active module transition adapters, wherein each of the plurality of transmit/receive active modules is coupled to a respective feed of the plurality of feeds spaced around and directed into the spherical lens by a respective one of the feed to T/R active module transition adapters.

Example 19 includes the planar multi-feed assembly of any of examples 14-18, wherein the transmit/receive active module and the reciprocal gain block each receive a control signal originating from a datalink radio, wherein an operating state of one or both of the transmit/receive active module and the reciprocal gain block are controlled based on the control signal.

Example 20 includes the planar multi-feed assembly of any of examples 14-19, wherein the feed comprises a dielectric filled circular waveguide.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. An active multiple beam antenna system, the system comprising:

a spherical lens;

a plurality of planar multi-feed assemblies spaced around a region of the spherical lens, wherein each of the planar multi-feed assemblies comprises:

a plurality of feeds spaced around and directed into the spherical lens;

a plurality of non-phase shifting transmit/receive active modules, wherein one respective transmit/receive active module of the plurality of transmit/receive active modules is coupled to each of the plurality of feeds;

a first power divider coupled to each of the plurality of transmit/receive active modules; and a second power divider coupled to the first power divider of each of the plurality of planar multi-feed assemblies, the first power divider further configured to couple with a datalink radio;

a plurality of reciprocal gain blocks, wherein each one of the plurality of reciprocal gain blocks are coupled between the first power divider of a respective planar multi-feed assembly and the second power divider wherein a first reciprocal gain block of the plurality of reciprocal gain blocks comprises:

a transmit amplifier switchably coupled between a first RF coupler and a second RF coupler; and a receive amplifier switchably coupled between the first RF coupler and the second RF coupler;

wherein the first RF coupler is further coupled to the first power divider and the second RF coupler is further coupled to the second power divider; and wherein each one of the plurality of reciprocal gain blocks are individually operable to switch on and off; and wherein each one of the plurality of reciprocal gain blocks are individually operable to switch between transmit and receive modes.

2. The system of claim 1, wherein the plurality of reciprocal gain blocks each receive a control signal originating from the datalink radio, wherein an operating state of one or both of the transmit amplifier and the receive amplifier are controlled based on the control signal.

3. The system of claim 2, wherein reciprocal gain blocks each receive a control signal originating from the datalink radio, wherein an operating state of one or both of the first RF coupler and the second RF coupler are controlled based on the control signal.

4. The system of claim 1, wherein the active multiple beam antenna system is configured to select an RF signal in a specified direction by controlling which of the plurality of transmit/receive active modules are in an operable state, and which of the plurality of reciprocal gain blocks are in an operable state.

5. The system of claim 1, wherein a first of transmit/receive active module of the plurality of transmit/receive active modules comprises:

a power amplifier coupled between a first RF coupler and a second RF coupler; and a low noise amplifier coupled between the first RF coupler and the second RF coupler;

wherein the first RF coupler is further coupled to the first power divider and the second RF coupler is further coupled to a feed of the plurality of feeds spaced around and directed into the spherical lens.

6. The system of claim 5, wherein the plurality of transmit/receive active modules each receive a control signal originating from the datalink radio, wherein an operating state of one or both of the power amplifier and the low noise amplifier are controlled based on the control signal.

7. The system of claim 5, wherein the plurality of transmit/receive active modules each receive a control signal originating from the datalink radio, wherein an operating state of one or both of the first RF coupled and the second RF coupler are controlled based on the control signal.

8. The system of claim 1, wherein the plurality of feeds each comprise a dielectric filled circular waveguide.

9. The system of claim 1, wherein each of the plurality of planar multi-feed assemblies further comprises a structure that further comprises the plurality of transmit/receive active modules.

10. The system of claim 9, wherein the plurality of planar multi-feed assemblies further comprise a plurality of feed to T/R active module transition adapters, where each of the plurality of feeds spaced around and directed into the spherical lens is coupled to a respective one of the plurality of transmit/receive active modules by one of the feed to T/R active module transition adapters.

11. The system of claim 1, wherein the active multiple beam antenna system is configured to select an RF signal in a specified direction by controlling which of the plurality of transmit/receive active modules are in an operable state.

12. A planar multi-feed assembly for an active multiple beam antenna system, the planar multi-feed assembly comprising:

a plurality of feeds spaced around and directed into a spherical lens;

a plurality of non-phase shifting transmit/receive active modules, wherein one respective transmit/receive active module of the plurality of transmit/receive active modules is coupled to each of the plurality of feeds;

a first power divider coupled to each of the plurality of transmit/receive active modules; and a reciprocal gain block coupled to the first power divider and to a second power divider, wherein the second power divider is configured to couple with a data link radio;

wherein the reciprocal gain block comprises:

a transmit amplifier switchably coupled between a first RF coupler and a second RF coupler; and a receive amplifier switchably coupled between the first RF coupler and the second RF coupler;

wherein the first RF coupler is further coupled to the first power divider and the second RF coupler is further coupled to the second power divider; and wherein the reciprocal gain block is individually operable to switch on and off; and wherein the reciprocal gain block is individually operable to switch between transmit and receive modes.

13. The planar multi-feed assembly of claim 12, wherein the second power divider is further coupled to a plurality of additional planar multi-feed assemblies.

14. The planar multi-feed assembly of claim 12, wherein the transmit/receive active module comprises:

a power amplifier coupled between a first RF coupler and a second RF coupler; and a low noise amplifier coupled between the first RF coupler and the second RF coupler;

wherein the first RF coupler is further coupled to the first power divider and the second RF coupler is further coupled to a first feed of the plurality of feeds spaced around and directed into the spherical lens.

15. The planar multi-feed assembly of claim 12, further comprising:

a structure that further comprises:

the plurality of transmit/receive active modules; and a plurality of feed to T/R active module transition adapters, wherein each of the plurality of transmit/receive active modules is coupled to a respective feed of the plurality of feeds spaced around and directed into the spherical lens by a respective one of the feed to T/R active module transition adapters.

16. The planar multi-feed assembly of claim 12, wherein the transmit/receive active module and the reciprocal gain block each receive a control signal originating from a datalink radio, wherein an operating state of one or both of the transmit/receive active module and the reciprocal gain block are controlled based on the control signal.

17. The planar multi-feed assembly of claim 12, wherein the feed comprises a dielectric filled circular waveguide.

* * * * *